US008863895B2

(12) United States Patent
Cheng et al.

(10) Patent No.: US 8,863,895 B2
(45) Date of Patent: Oct. 21, 2014

(54) SILENCER INCORPORATING ELONGATED MEMBERS

(71) Applicant: Aero Systems Engineering, Inc., St. Paul, MN (US)

(72) Inventors: Chunyuen R. Cheng, Woodbury, MN (US); Thomas H. Nathan, Forest Lake, MN (US)

(73) Assignee: Aero Systems Engineering, Inc., St. Paul, MN (US)

( * ) Notice: Subject to any disclaimer, the term of this patent is extended or adjusted under 35 U.S.C. 154(b) by 0 days.

(21) Appl. No.: 13/847,762

(22) Filed: Mar. 20, 2013

(65) Prior Publication Data

US 2013/0248282 A1 Sep. 26, 2013

Related U.S. Application Data

(60) Provisional application No. 61/613,768, filed on Mar. 21, 2012.

(51) Int. Cl.
*E04F 17/04* (2006.01)

(52) U.S. Cl.
USPC ..... 181/224; 181/286; 454/341

(58) Field of Classification Search
CPC ..... F24F 13/24; F16L 55/033; G10K 11/172
USPC ..... 181/224, 286; 454/431
See application file for complete search history.

(56) References Cited

U.S. PATENT DOCUMENTS

| | | | | | |
|---|---|---|---|---|---|
| 2,979,058 | A | * | 4/1961 | Schur | 131/331 |
| 3,094,189 | A | * | 6/1963 | Dean, Jr. | 181/259 |
| 3,141,655 | A | * | 7/1964 | Platt | 404/6 |
| 3,454,128 | A | * | 7/1969 | Nopper | 181/224 |
| 3,511,336 | A | * | 5/1970 | Rink et al. | 181/224 |
| 5,228,479 | A | * | 7/1993 | Thomas | 138/149 |
| 5,663,536 | A | * | 9/1997 | Kaplan | 181/224 |
| 5,728,979 | A | * | 3/1998 | Yazici et al. | 181/224 |
| 5,859,393 | A | * | 1/1999 | Cummins et al. | 181/257 |
| 7,510,052 | B2 | * | 3/2009 | Ayle | 181/292 |
| 2006/0037813 | A1 | | 2/2006 | Ozeki et al. | |
| 2011/0168483 | A1 | | 7/2011 | Chow et al. | |

FOREIGN PATENT DOCUMENTS

WO WO 2006/118443 A1 11/2006

OTHER PUBLICATIONS

International Search Report mailed on Jun. 7, 2013 in connection with International Patent Application No. PCT/US13/33108. 1 page.

* cited by examiner

*Primary Examiner* — Forrest M Phillips

(57) ABSTRACT

A matrix or array of elongated tubular members, each member being formed by spirally winding a piece or pieces of material into a generally cylindrical shape, wherein the matrix or array is mounted in an airflow to reduce the noise associated with and/or produced by the airflow.

21 Claims, 10 Drawing Sheets

SILENCER INCORPORATING ELONGATED MEMBERS

CROSS-REFERENCE TO RELATED APPLICATION(S)

This application claims priority to U.S. Provisional Patent Application No. 61/613,768, filed on Mar. 21, 2012, the entire content of which is incorporated herein by reference.

FIELD

The present invention relates to devices for muffling, controlling, abating, and/or reducing noise, and to methods of making and using such devices. More particularly, the present invention relates to a noise reduction device, to elongated members comprising the device, and to the shape and arrangement or configuration of the elongated members. More particularly, the present invention relates to a noise reducing structure comprising a plurality of elongated, tubular members. In some embodiments, the present invention comprises a matrix or array of elongated tubular members, each member being formed from a piece or pieces of spirally wound material, wherein the matrix or array is mounted in an airflow to reduce the noise associated with and/or produced by the airflow.

BACKGROUND

Facilities and/or operations involving high volume air flows, for example wind tunnels, gas turbine engine test facilities, power generation facilities, industrial or manufacturing facilities, e.g., vehicle manufacturing and testing facilities, or any other facility that houses or uses a prime mover, typically move or flow large or massive amounts of air when in operation. Due to the air flow(s) and/or other processes, they may generate very high acoustic levels inside and outside the facility. Noise created by air flow is, among other mechanisms or causes, the result of shearing within the flow due to high velocity gradient in adjacent flow paths. Typically, air flowing both in and out of these facilities must be treated acoustically to maintain acceptable sound and/or noise levels, e.g. in the surrounding community, and the noise must be mitigated without excessive resistance and while maintaining uniform flow. Typically, sound absorbing or insulating structure(s) are used to absorb acoustical energy from the air flow. Such structures are generally required on both the inlet and exhaust side, and may be referred to and/or known as acoustical baffles. Additionally, facilities such as those mentioned above and/or others also typically require a well behaved interior air flow to maintain stable processes. Acoustical baffles may serve a dual purpose as they reduce noise and assist in maintaining conditioned interior air flow.

The general approach to the noise problem in facilities or situations such as those mentioned above by way of example may be to integrate a large array of absorptive baffles in inlet and/or exhaust segments. The shape, spacing, and effective length of these baffles are dictated by the specific frequency distribution and amplitude of the source noise as compared to the desired values outside the facility. To mitigate the higher acoustic energy levels long or thick baffles are generally required.

Historical implementations of acoustical baffles in gas turbine engine test facilities, for example, include installation of many large "slab-type" acoustical baffles. These baffles are in the shape of a rectangular prism and generally have aerodynamic features, such as triangular or hemispherical caps on the leading and trailing edges. The baffles typically have an internal skeletal structure forming partitions for absorptive acoustical material. The sides of the structures are clad with perforated steel material. The baffles are typically suspended vertically in inlet and exhaust flow streams in an orientation with the "slabs" or baffles aligned vertically with the direction of flow. Spacing between baffles and installed lengths are determined by the required aerodynamic and acoustical requirements of the facility, e.g. the test cell. A common problem with this type of baffle is their massive size which makes them very expensive to manufacture and difficult to install. Further, the spacing between baffles forms large segregated channels that partitions the air flow. This partitioning does not provide good mixing within the air flow or the potential for correction and/or adjustment of airflow distribution, if necessary, to produce a final total flow stream with a well behaved and uniform velocity distribution. Implementation of this type of baffle has resulted in, in addition to other undesirable phenomena: noise induced by the baffles themselves, ineffective noise reduction, and re-entrainment of exhaust air due to the significant differences in velocity in adjacent partitions.

Another difficulty with such known baffles is welding may be commonly employed to attach relatively thin perforated skins to the structures. With high vibration levels, these welds can be sources of failure due to local hardening adjacent to the weld and thermal stresses.

The use of "square bar silencers" to replace the slab-type baffles is known. Instead of installing rows of a few large slab-type baffles, a matrix or grid of smaller baffles in the shape of a square prism is installed in the air flow. The bars are suspended with the long direction in the direction of air flow. The dimensions of the square section, the length of the bar, and the spacing of bars are dependent on the noise attenuation and aerodynamic requirements of the test cell. The primary benefits of this type of configuration are lower cost of manufacture, installation and servicing, and more ease in "tuning" the performance of the baffle system by modifying the grid for optimum acoustical attenuation. Unlike slab-type baffles, this type of baffle does not partition the air flow so the air can "fill" the volume and normalize to a final flow with a small, uniform velocity distribution. The disadvantage of these baffles is still a high cost to manufacture. The four sided square also increases the surface area that can be installed in a given length of baffles. By reducing the installed length, building geometries are reduced and acoustic outer packaging is reduced. To be effective, the overall surface area of the absorptive baffles must be significant. This requires a large material content that also drives cost. While an improvement over slab-type baffles, they are still typically expensive to manufacture, install and maintain.

SUMMARY

The accompanying drawings and this description depict and describe embodiments of devices for reducing noise in accordance with the present invention, and features and components thereof. The present invention encompasses a method of making and using embodiments of said devices.

Any reference to "the invention" in this application shall not be construed as a generalization, limitation or characterization of any subject matter disclosed herein and shall not be considered to be an element or limitation of the appended claims except if and/or where explicitly recited in a claim(s). With regard to fastening, mounting, attaching or connecting components, unless specifically described as otherwise, conventional mechanical fasteners and methods may be used.

Other appropriate fastening or attachment methods include adhesives, welding and soldering, including with regard to an electrical sensor or component, if any. Generally, unless otherwise indicated, the materials for making embodiments and/or components thereof may be selected from appropriate materials such as metal, metallic alloys, ceramics, plastics, etc. Unless otherwise indicated specifically or by context, positional terms (e.g., up, down, front, rear, distal, proximal, etc.) are descriptive not limiting. Same reference numbers are used to denote same parts or components.

In one embodiment, the present invention comprises a cylindrical bar silencer wherein the bars are tubes or pipes made from a perforated material wound in a spiral winding process. In some embodiments, the tubes are packed with acoustical filler material capable of maintaining its integrity while exposed to a high temperature air flow, e.g. the flow found in gas turbine engine test facilities. In some embodiments, the acoustical filler is a "pillow" of a fibrous material, e.g. basalt wool, encased by a temperature resistant casing that both contains the fibrous material and protects it from the violent air flow that the tubes are exposed to in use. In some embodiments, the ends of the tubes comprise aerodynamically shaped caps made without welding (e.g. by spinning, turning, forming or punching) or with minimal welds and having hardware interfaces for installation on the tubes and/or for the installation or mounting of the tubes in an airflow.

A silencing device in accordance with the present invention can be made for less cost than known square bar silencers due to the spiral winding or spiral tube or pipe manufacturing method. With this design, tubular baffle bodies can be manufactured in less time. Also, tubular baffle bodies in accordance with the present invention are not subject to the size and/or length limiting factor for square bar silencers, i.e. commercially available brake presses. If a particular application requires a longer square bar silencer, it is necessary to fabricate a single part from multiple parts. This adds to the cost of manufacturing. The length of the tubular bar silencer in accordance with the present invention is practically unlimited due to the manufacturing process. Another advantage is welding of the tubular body is minimal so sources of stress concentration are reduced. These advantages allow for a low cost method to produce purpose designed/built bar silencers.

In one embodiment, the present invention provides a noise reducing arrangement of elongated members. In one embodiment, the elongated members are generally cylindrical, hollow tubes formed by a perforated shell or skin. In some embodiments, some of the elongated members may be other than cylindrical, e.g. oval or semi-circular, including at the periphery of the arrangement.

In one embodiment, the present invention provides sound reduction using a cylindrical bar shape to form an acoustic absorber in an aerodynamic test facility wherein the cylindrical bar shape is created by the spiral winding of a metal sheet, the edges of the spirally wound metal sheet being crimped to form a crimped seam or otherwise suitable joined, the ends of the bar shapes carrying a cap or dome, which may have a flat, hemispherical or other aerodynamic shape, for mounting the bar shapes in an array in an airflow of the test facility. The caps or domes may be spun or punched to help minimize fabrication and installation welding, and help provide uniform airflow and a structurally efficient support member. The bar shapes may be spaced relative to one another in the array to optimize the desired level of acoustic absorption. The cylindrical bar shapes may be used in, for example, the exhaust section of an aerodynamic test cell to assure adequate "pumping" of the cell and flow stability and direction, e.g., they may be used in the vertical exhaust stack of a test cell to reduce low-to-mid frequency acoustic noise, wherein they may be adapted to be exposed to higher velocity and hotter flows. They may also be used in air inlets for sound suppression and to help provide flow conditioning, e.g. to redistribute airflow thereby reducing velocity, to provide a stable, vortex-free airflow, etc.

In one embodiment, the present invention involves using acoustic baffles fabricated as elongated cylinders formed using a spiral winding or spiral wound fabrication technique resulting in cylinders that may be made in diameters and/or lengths to precisely match the acoustic containment or abatement design, to allow lateral mixing of the air as it flows through the cylinders, and/or to minimize flow velocities through the cylinders. In some embodiments, the cylinders are fabricated from a perforated sheet of metal spirally wound wherein the edges are joined or crimped together to form a continuous seam and an unperforated margin exits at the seam. In some embodiments, an acoustic packing in a pillow is in the cylinder, the size of the packing and/or pillow and the density of the packing and/or the fabric forming the pillow being chosen to provide a precise flow resistance to match the requirements of the acoustic design. In some embodiments, the cylinders are arranged in a matrix to fill a flow field to a level compatible with a compromise of flow resistance and acoustic performance, and the spacing of the cylinders is established to provide acoustic absorption specifically targeting certain frequencies for attenuation. In some embodiments, the cylinders at the edges of the array may be flattened to a selected degree, e.g. oval or semi-circular in shape.

While multiple embodiments are mentioned herein, still other embodiments and/or aspects of the present invention will become apparent to those skilled in the art from the accompanying drawings and description, which show and describe illustrative and/or exemplary embodiments of the invention. As will be realized, the invention is capable of modifications in various obvious aspects, all without departing from the spirit and scope of the present invention. Accordingly, the drawings and detailed description are to be regarded as illustrative in nature and not restrictive.

DETAILED DESCRIPTION

Figure 1:
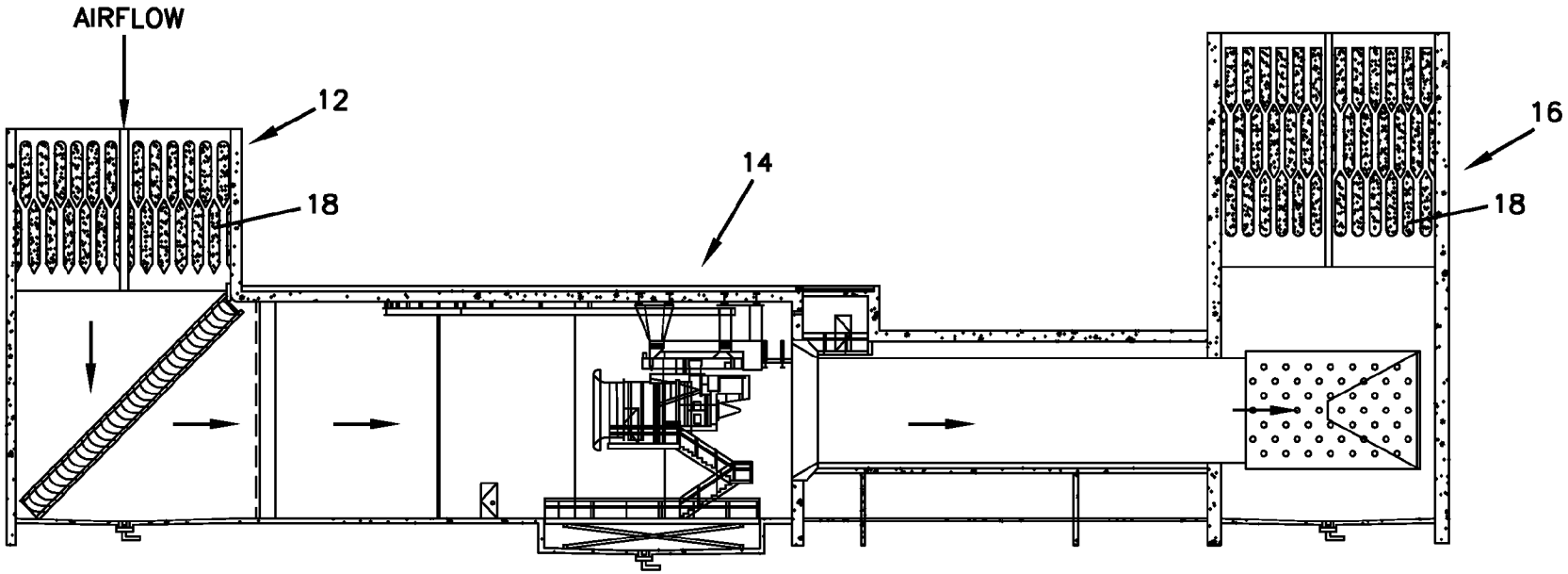
FIGS. 1 and 2 depict exemplary embodiments of a situation in which an embodiment of the silencer of the present invention may be used, namely exemplary aerodynamic test cells.
Figure 2:
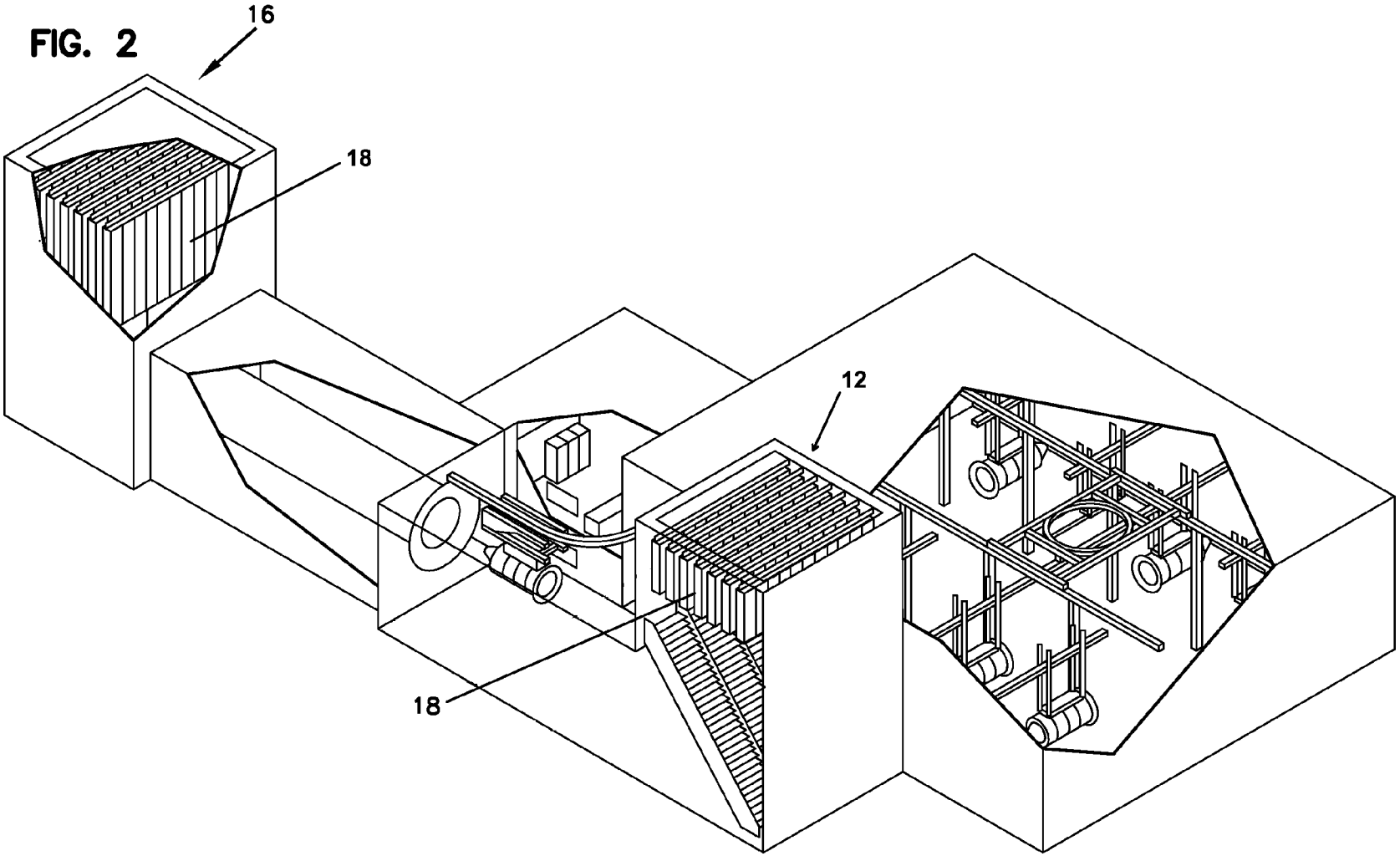

FIGS. 1 and 2 depict exemplary embodiments of a facility in which a silencer or silencers in accordance with the present invention may be used, namely an aerodynamic testing facility. Typically, such facilities comprise an inlet and conditioning portion 12, a central test cell portion 14 and an outlet or exhaust portion 16. A silencer in accordance with the present invention, e.g. an array incorporating generally cylindrical elongated members, may be used in the inlet and exhaust portions in conjunction with or to replace the depicted acoustical baffles 18, and/or where otherwise appropriate.

Figure 6:
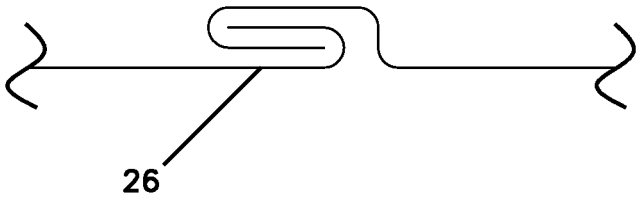

With reference to FIGS. 3A-D, one embodiment of the present invention comprises an array or matrix 22 of elongated, generally cylindrical members 24 formed by winding a piece or pieces of material, e.g. metal, in a spiral and joining the adjacent edges thereby forming a continuous length of hollow cylindrical tube or pipe. As can be seen, the array or matrix 22 comprises a selected number of members 24, selectively, suitably arranged. The seam or joint 26 along the edges may be suitable formed, e.g. by crimping, as depicted in FIG. 6.

The members 24 are spaced from each other at a selected distance and are generally parallel. The array or matrix 22 can comprise a selected number of members and selected spacing between members. In some embodiments, a central portion 30 of the array comprises cylindrical members, and a periphery comprises, at least in part, semi-circular and/or half or half-round members 33. The periphery or a portion thereof may also comprise flattened or partially flattened members, e.g., oval members (not shown). Each member has two ends, each end carrying a cap 34 (see FIG. 3B). The caps 34 may be suitably connected to the members 24, e.g. by welding or other suitable methods and/or structures, and may be adapted to connect or mount the members 24 at one or both ends to a supporting structure in the selected arrangement of members forming the array or matrix 22. In some embodiments, the caps 34 may be created by being spun, turned, formed or punched, whereby welding or use of other connective hardware may be reduced or minimized.

Figure 3A:
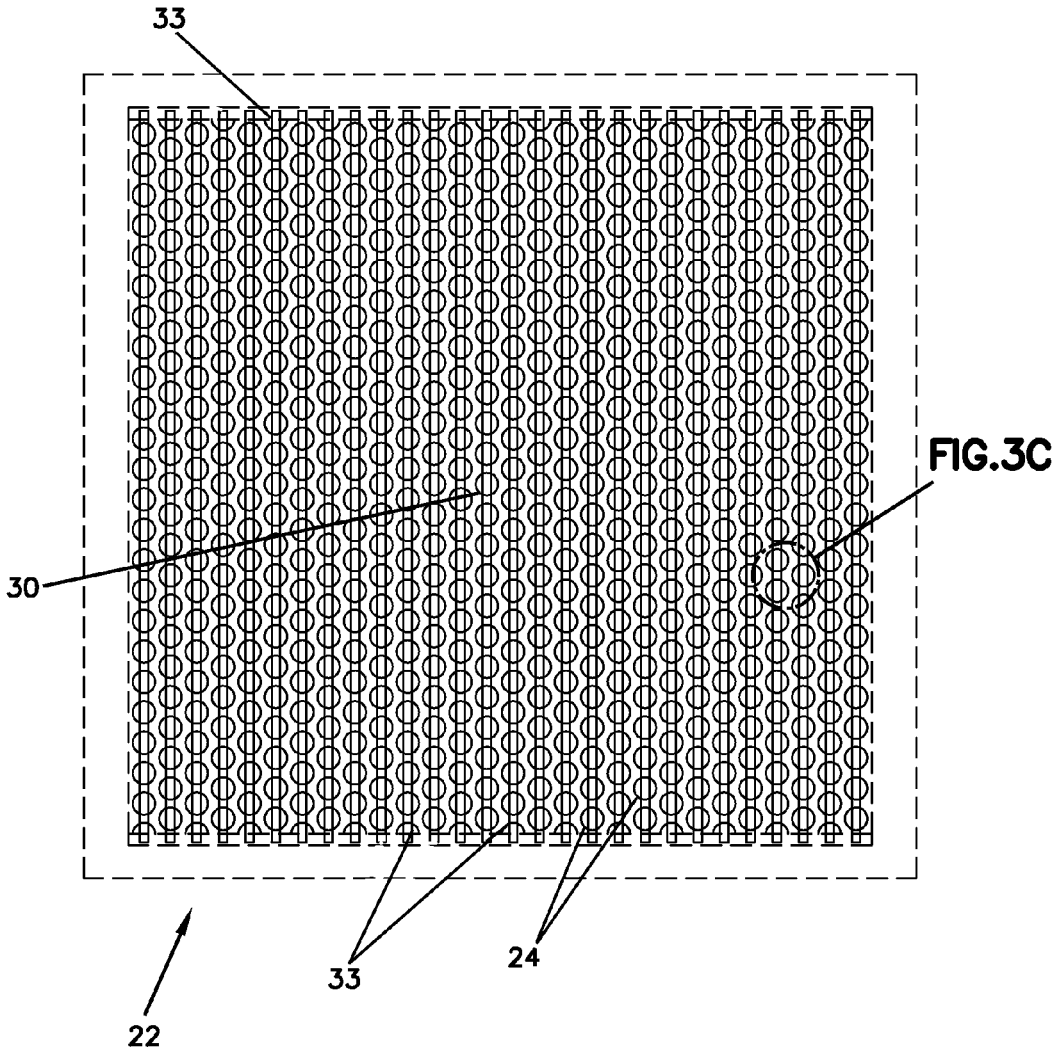
FIG. 3A-D depict aspects and embodiments of a silencer array in accordance with the present invention, along with portions of embodiments of round or cylindrical elongated bar members in accordance with the present invention.
Figure 3D:
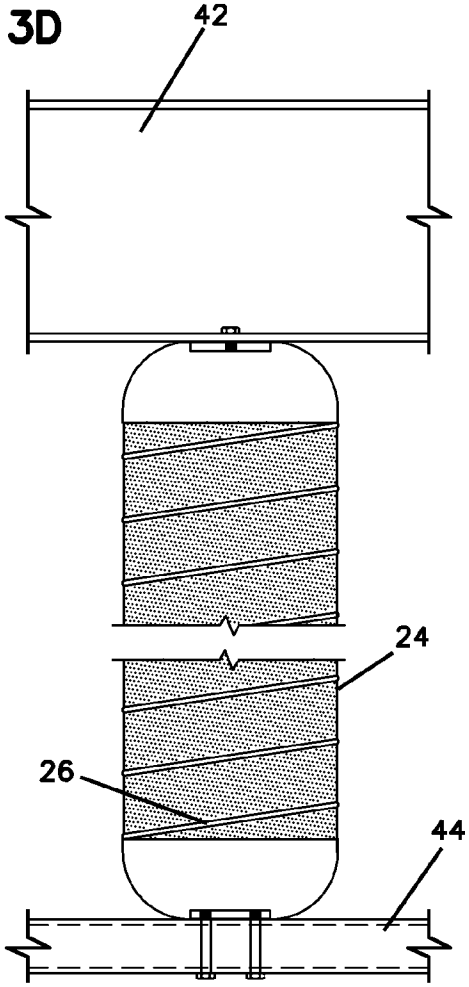
Figure 3C:
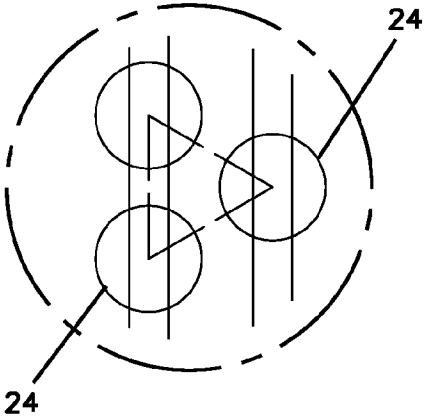
Figure 3B:
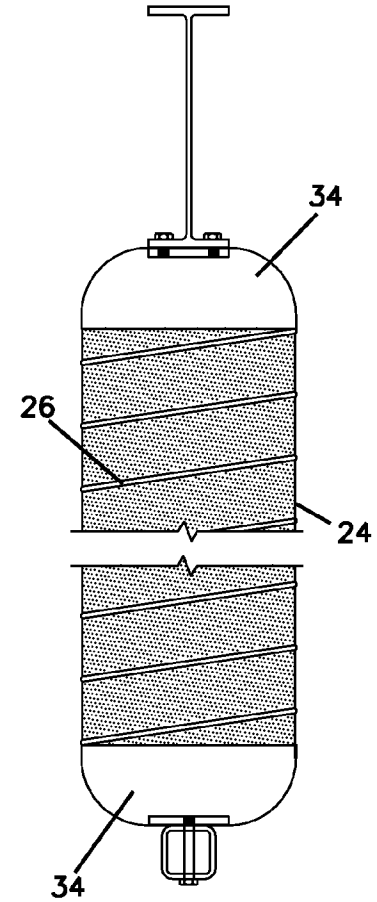

FIGS. 3B and D illustrate examples of how the cylindrical or round bar or pipe members 24 may be supported in an array or matrix 22, namely by a suitable supports such as support tube or beam 42 and/or retainer tube 44. FIG. 3C depicts an array 22 with the members 24 or array at 50% open, although the spaces and spacing may be selected, depending on design, use, installation and/or performance specifications. While uniform spacing or layout of the members 24 and/or array 22 is depicted, it should be appreciated that spacing and layout may be other than what is depicted depending on design, use, installation and/or performance specifications.

Figure 4A:
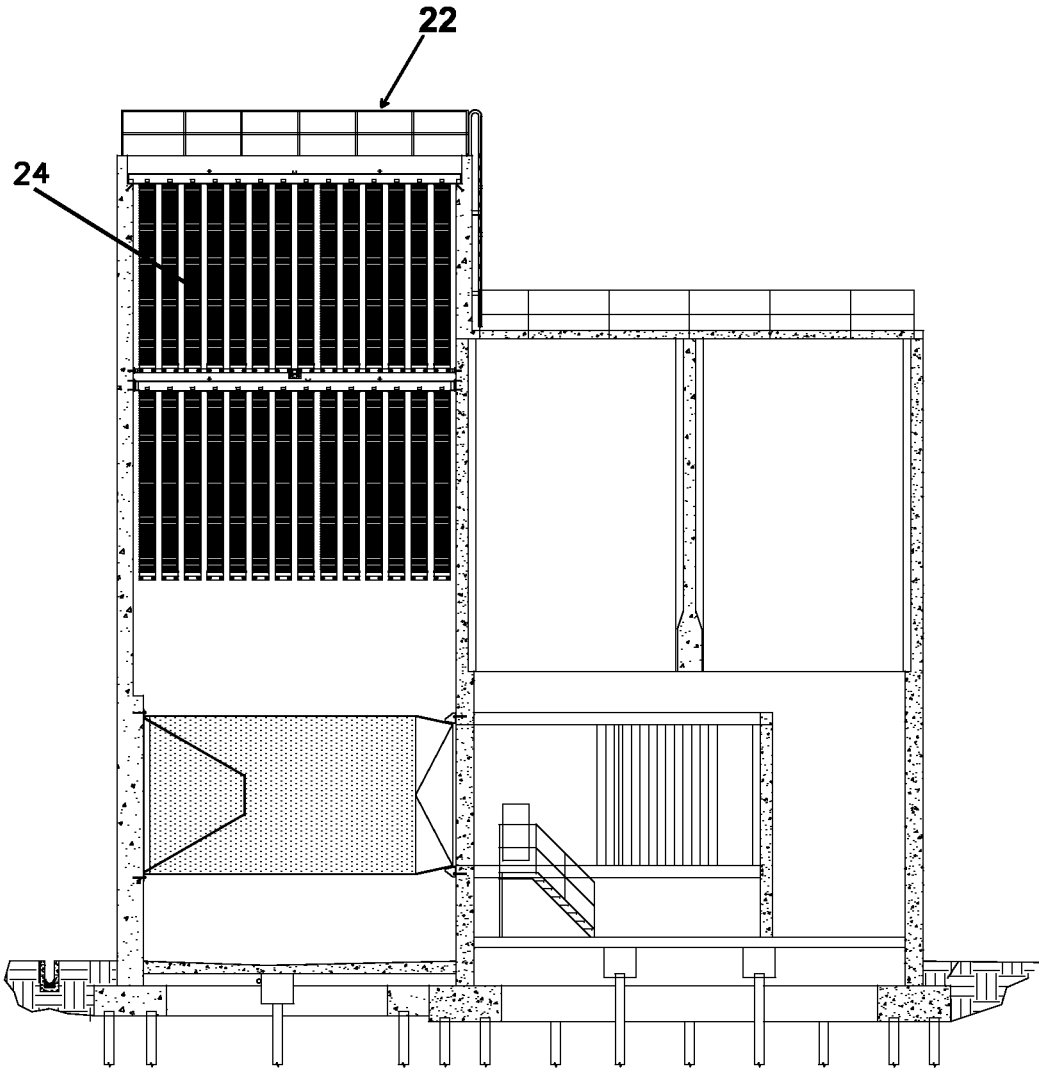
FIGS. 4A and B depict embodiments of elongated members in accordance with the present invention arranged in embodiments of an array or matrix in accordance with the present invention, and depict embodiments of how the arrays or matrices may be disposed or positioned in use.
Figure 4B:
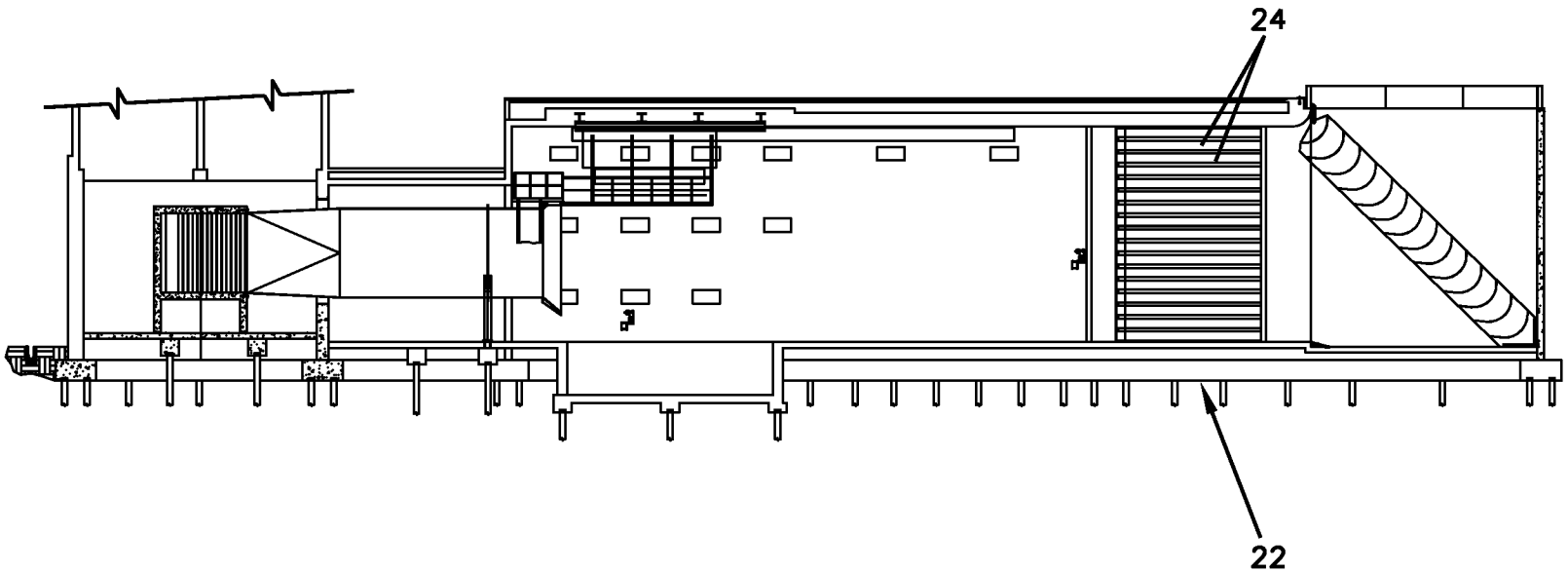

FIGS. 4A and B depict embodiments of the members 24 and array 22 of the present invention as they might be arranged or situated in an airflow, e.g. parallel to the airflow in a horizontal installation or a vertical installation. The pattern of and/or spacing between the members 24 can be varied depending on noise abatement design specifications and/or performance characteristics.

Figure 5A:
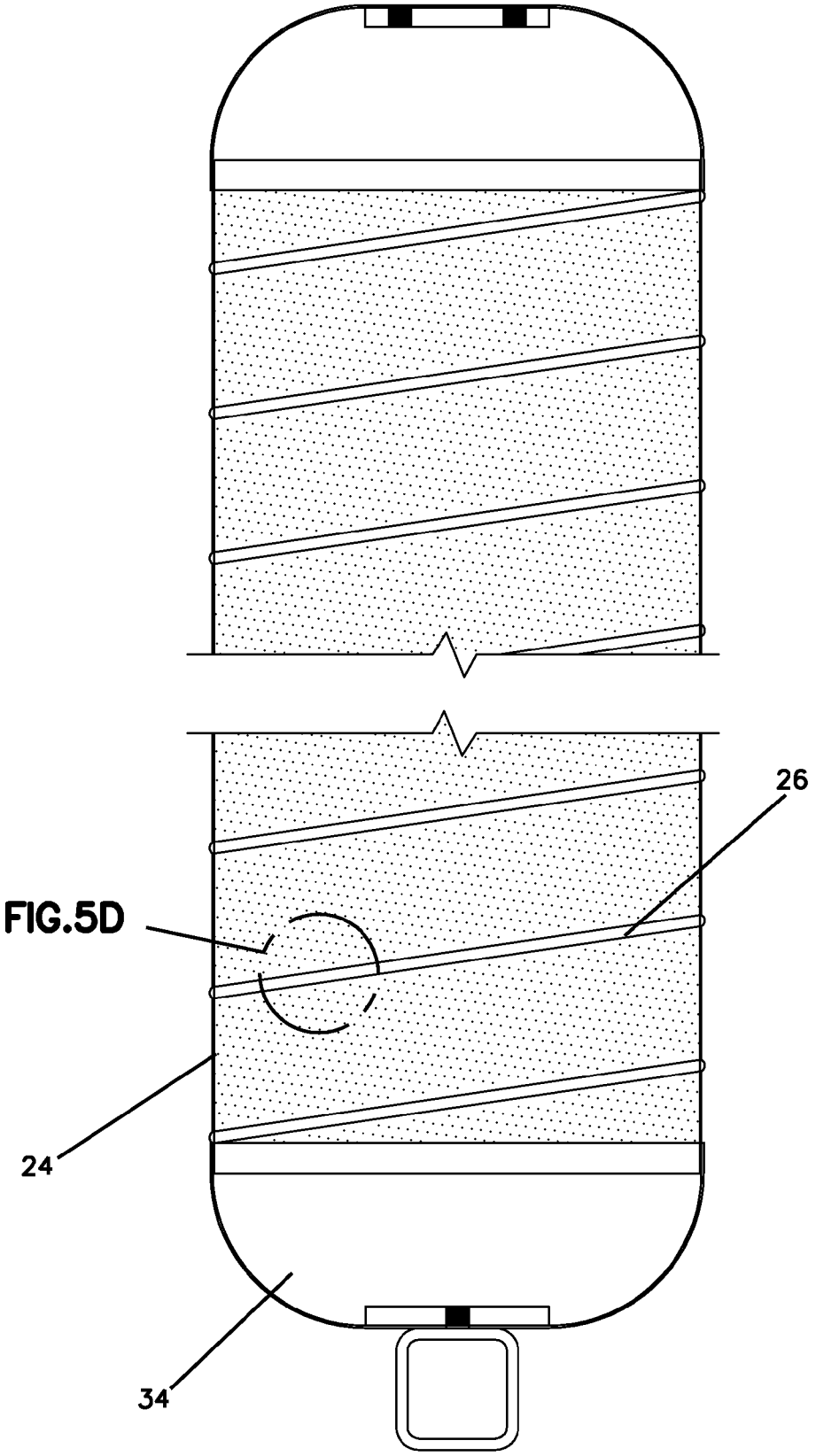
FIGS. 5A, 5C, 5D and 6 depict embodiments of a tubular member in accordance with the present invention, namely portions of embodiments of a tube or pipe formed by a spiral winding process.
Figure 5B:
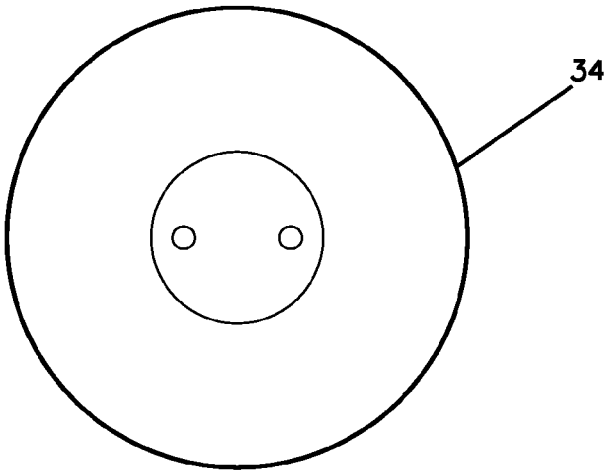
FIGS. 5B and 7A-B depict embodiments of an end cap or dome in accordance with the present invention for use at the ends of elongated members in accordance with the present invention.
Figure 5C:
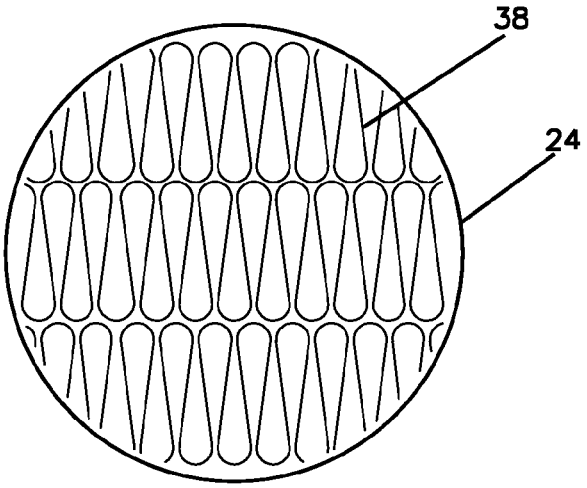
Figure 5D:
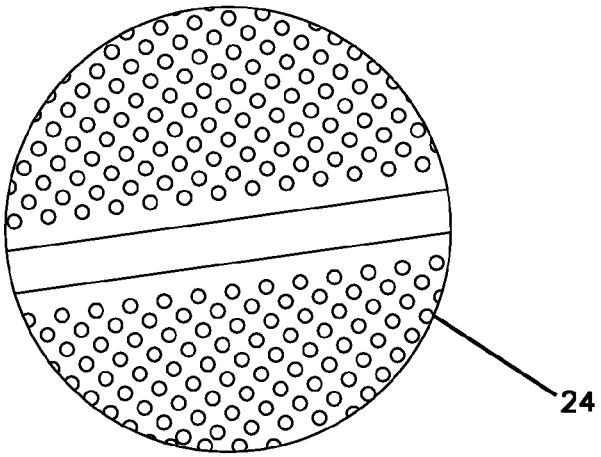

FIGS. 5A-D depict a portion of an embodiment of a spiral wound tube or pipe member 24 for use in the present invention. The tube 24 is an elongated cylinder which can have a selected diameter and length. It is formed by winding a sheet or sheets of material, e.g. a selected gauge of metal, in a spiral, then joining the adjacent edges. FIG. 5C depicts one embodiment of members 24 packed with acoustically absorptive material 38. An exemplary seam or join of edges 26 is depicted in FIG. 6. The seam 26 is created by folding and/or crimping and provides a continuous reinforcing rib. In some embodiments, the pipe can be a dual wall pipe comprising two spirally wound elongated members, one concentrically inside the other.

Figure 7A:
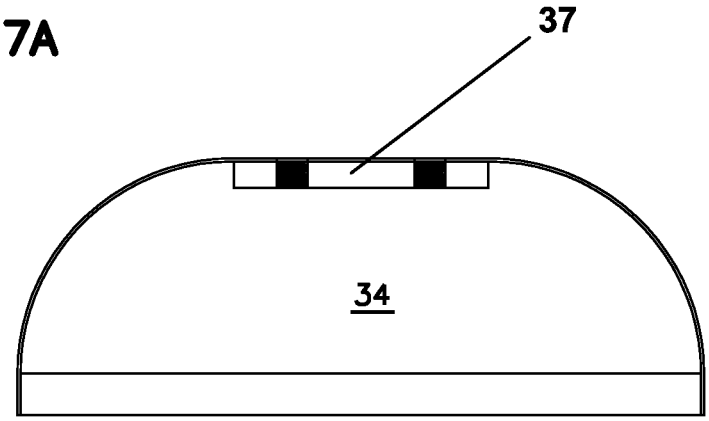
Figure 7B:
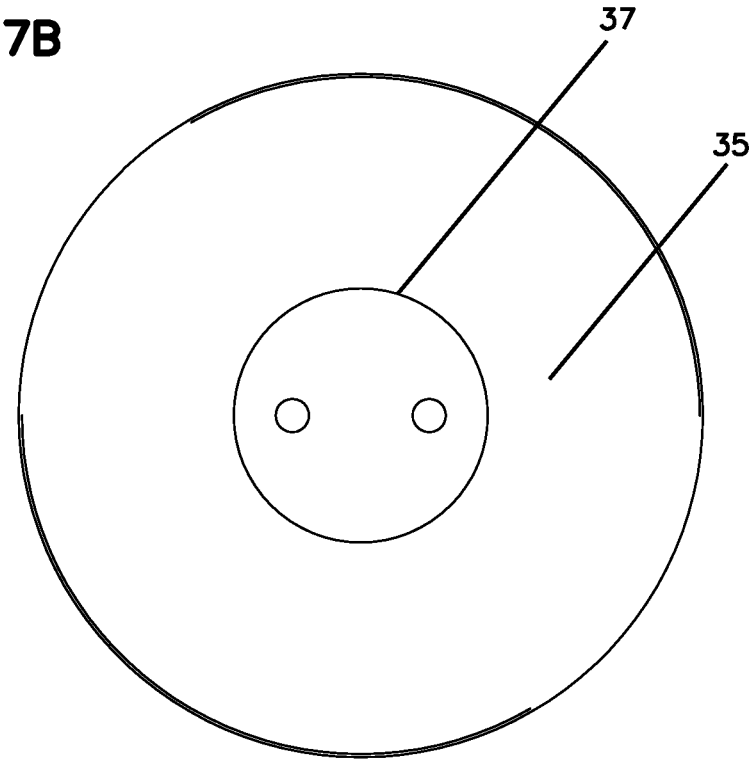

FIGS. 7A and B depict one embodiment of an end cap 34, wherein the cap 34 is a single piece of suitable material turned, spun, formed or punched to form the desired shape. In this example, a generally hemispherical shape is shown, with a flattened portion 35 at the pole or apex of the cap 34. A reinforcing disk 37 may be secured to or formed in the cap 34. The caps 34 may be generally conical or frustoconical, as well as otherwise shaped. The caps 34 may be adapted to various shapes of the members 24, and/or to design, use, installation and/or performance specifications.

in this application, embodiments of the present invention, including preferred embodiments, have been presented for the purpose of illustration and description. They are not intended to be exhaustive or to limit the invention to the precise forms disclosed. The embodiments were chosen and described to provide the best illustrations of the principals of the invention and its practical use, and to enable one of ordinary skill in the art to utilize the invention in various embodiments and with various modifications as are suited to a particular use contemplated. The scope of the invention should be determined by the appended claims when interpreted in accordance with the breadth they are fairly, legally, and equitably entitled.

The invention claimed is:

1. A baffle system comprising:

a plurality of elongated, generally tubular baffle members arranged in a gas flow and positioned in a spaced arrangement relative to each other, generally parallel to the gas flow;

wherein the baffle members each comprise a perforated shell configured for acoustic absorption to reduce noise generated by the gas flow, and to provide lateral flow redistribution through the plurality of baffle members to condition the gas flow.

2. The baffle system according to claim 1, further comprising an acoustically absorptive material packed within the baffle members.

3. The baffle system according to claim 1, further comprising a support structure configured to mount the plurality of baffle members in the gas flow, wherein the baffle members are uniformly spaced at a distance selected for aerodynamic requirements of the gas flow.

4. The baffle system according to claim 1, wherein a length of the baffle members is selected based on a frequency distribution of the noise.

5. The baffle system according to claim 1, wherein the tubular baffle members each comprise a spiral wound, crimped seam joining adjacent edges of the perforated shell and providing a continuous reinforcing rib structure therein.

6. The baffle system according to claim 1, further comprising a generally hemispherical end cap at an end of each of the tubular baffle members, the end cap adapted to support the respective baffle members in the gas flow.

7. The baffle system according to claim 6, wherein the end cap is spun, formed or punched in a generally hemispherical shape with a flattened apex portion.

8. The baffle system according to claim 6, wherein the end cap is aerodynamically shaped and configured to provide and maintain uniform gas flow.

9. The baffle system according to claim 8, further comprising a reinforcing disk secured to the end cap.

10. The baffle system according to claim 5, wherein the tubular baffle members are supported at one or both ends by a supporting structure in a generally parallel orientation to the gas flow and arranged in a matrix configured for mounting the baffle members in the gas flow.

11. The baffle system according to claim 10, wherein some of the baffle members are generally cylindrical.

12. The baffle system according to claim 10, wherein some of the baffle members are other than cylindrical, oval, flattened or semi-circular.

13. A method comprising:

providing a plurality of elongated, tubular, generally cylindrical baffle members, each baffle member formed by winding a length of perforated shell material in a spiral and joining adjacent edges of the perforated shell material together at a seam to form a continuous reinforcing rib in the perforated shell material;

arranging the baffle members in an array wherein the baffle members are mounted to a supporting structure at one or both ends, in a generally parallel and selectively spaced matrix configuration;

positioning the array in a gas flow, wherein the baffle members are arranged generally parallel to the gas flow to reduce noise by acoustic absorption, and to provide lateral flow redistribution through the baffle members to condition the gas flow for improved flow uniformity.

14. The method according to claim 13, further comprising selectively spacing the baffle members at a uniform distance selected for aerodynamic requirements of a testing facility associated with the gas flow.

15. The method according to claim 13, further comprising selecting a length of the baffle members according to a frequency distribution of the noise.

16. The method according to claim 13, wherein the perforated shell material comprises a perforated metal material, and further comprising at least partially filling the baffle members with an acoustically absorptive material.

17. The method according to claim 13, wherein positioning the array in the gas flow comprises mounting the baffle members in an aerodynamic test facility, a wind tunnel, a gas turbine engine test facility, a power generation facility, an industrial or manufacturing facility, a vehicle manufacturing facility or a vehicle testing facility.

18. A silencer system configured for use in a gas flow associated with an aerodynamic wind tunnel or engine facility the silencer system comprising:

an array of elongated, generally cylindrical and tubular acoustic baffle members, each acoustic baffle member formed of a spiral perforated shell winding having a crimped seam joining adjacent edges thereof, the crimped seam providing a continuous reinforcing rib in the perforated shell; and a supporting structure configured for mounting the array of acoustic baffle members at one or both ends thereof, the ends having aerodynamically shaped end caps with interfaces configured for mounting to the supporting structure and for arranging the baffle members in a generally parallel and selectively spaced configuration within the array;

wherein the baffle members are arranged generally parallel to the gas flow and configured to reduce the noise by acoustic absorption and to provide lateral flow redistribution through the baffle members to condition the gas flow for uniform velocity distribution.

19. The silencer system according to claim 18, wherein the baffle members are formed from perforated sheet metal having an unperforated margin adjacent the crimped seam joining the adjacent edges of the spiral perforated shell winding.

20. The silencer system according to claim 19, wherein the baffle members are uniformly spaced at a selected distance relative to each other, and wherein the distance is selected to reduce a targeted acoustic noise frequency in the gas flow.

21. The silencer system according to claim 18, wherein the acoustic baffle members have a length selected according to a frequency distribution of the noise and a uniform spacing distance selected for aerodynamic requirements of the wind tunnel or engine facility.

* * * * *